US006384779B1

(12) United States Patent
Lee

(10) Patent No.: US 6,384,779 B1
(45) Date of Patent: May 7, 2002

(54) METHOD FOR IMPROVING TRACKING SPEED OF SATELLITE ANTENNA

(75) Inventor: Dong-Min Lee, Kyungki-do (KR)

(73) Assignee: Hyundai Motor Company, Seoul (KR)

( * ) Notice: Subject to any disclaimer, the term of this patent is extended or adjusted under 35 U.S.C. 154(b) by 70 days.

(21) Appl. No.: 09/672,119

(22) Filed: Sep. 27, 2000

(30) Foreign Application Priority Data

Dec. 23, 1999 (KR) ..... 99-61007

(51) Int. Cl.[7] ..... H01Q 3/00
(52) U.S. Cl. ..... 342/359
(58) Field of Search ..... 342/359

(56) References Cited

U.S. PATENT DOCUMENTS 6,191,734 B1 * 2/2001 Park et al. ..... 342/359

* cited by examiner

*Primary Examiner*—Thomas H. Tarcza
*Assistant Examiner*—Fred H. Mull
(74) *Attorney, Agent, or Firm*—Christie, Parker & Hale, LLP

(57) ABSTRACT

Disclosed is a method for improving a tracking speed of a satellite antenna comprising the steps of receiving image signals and external light signals of a vehicle; determining if a value of the image signals is greater than a predetermined image signal value; re-positioning a satellite antenna if the value of the image signals is less than the predetermined image signal value such that the value of the image signals is increased; maintaining a present position of the satellite antenna if the value of the image signals is greater than the predetermined image signal value; determining if an absolute value of a previous external light signal value subtracted from a value of the present external light signals is less than a predetermined external light signal value, or if a tail light is illuminated, or if an automatic illumination system is operating; determining that the vehicle is travelling through a tunnel or a similarly obstructed location if any of the three conditions of the above step are met, and maintaining a pre-tunnel position value; determining whether the absolute value of the previous external light signal value subtracted from the value of the present external light signals is greater than the predetermined external light signal value; continuously maintaining the pre-tunnel position value if the absolute value is less than the predetermined external light signal value; and controlling the antenna as needed if the absolute value of the previous external light signal value subtracted from the value of the present external light signals is greater than the predetermined external light signal value.

4 Claims, 3 Drawing Sheets

METHOD FOR IMPROVING TRACKING SPEED OF SATELLITE ANTENNA

BACKGROUND OF THE INVENTION (a) Field of the Invention

The present invention relates to a method for improving a tracking speed of a satellite antenna, and more particularly, to a method in which an external light sensor and a steering angle sensor is used to improve a tracking speed of a satellite antenna.

(b) Description of the Related Art

An increasing number of vehicles are equipped with a satellite signal reception signal. When such a satellite antenna is provided on a vehicle, one of the most important factors to ensure optimal reception is the positioning of the antenna. That is, a central processing unit of an antenna unit monitors a position of the vehicle and of the antenna through a vehicle position sensor and an antenna position sensor. respectively, then performs control to drive a motor that varies the position of the antenna such the antenna is maintained in an optimal reception position.

Accordingly, when driving under normal conditions, a reception signal level is optimized by continuously varying the position of the antenna, that is, by performing a tracking operation that ensures the best possible reception signal. However, when driving under special conditions such as through a tunnel, since a position of the antenna for obtaining an optimal reception signal is not stored in the antenna unit. the tracking operation must again be performed when the vehicle exits the tunnel (i.e., returns to a normal driving condition). Accordingly, the quality of the reception signal deteriorates until the optimal signal level is again obtained.

In the case where a gyro sensor is used, the satellite antenna is moved leftward and rightward after the direction at which the vehicle is traveling is determined. However, if the vehicle is traveling on a slanted road surface, it is determined that the traveling direction of the vehicle is that of the slant. As a result, an optimal reception position is not obtained. Further, in the case where a controller is positioned in-line, the reception performance is deteriorated.

SUMMARY OF THE INVENTION

The present invention has been made in an effort to solve the above problems.

It is an object of the present invention to provide a tracking method for a satellite antenna in which tracking is quickly performed, even in the case where satellite signal reception is not continuous.

To achieve the above object, the present invention provides a method for improving a tracking speed of a satellite antenna. The method comprises the steps of receiving image signals and external light signals of a vehicle; determining if a value of the image signals is greater than a predetermined image signal value; re-positioning a satellite antenna if the value of the image signals is less than the predetermined image signal value such that the value of the image signals is increased; maintaining a present position of the satellite antenna if the value of the image signals is greater than the predetermined image signal value; determining if an absolute value of a previous external light signal value subtracted from a value of the present external light signals is less than a predetermined external light signal value, or if a tail light is illuminated, or if an automatic illumination system is operating; determining that the vehicle is travelling through a tunnel or a similarly obstructed location if any of the three conditions of the above step are met, and maintaining a position value of the antenna corresponding to that used directly before one of the three conditions of the above step was satisfied (i.e. a pre-tunnel position value); determining whether the absolute value of the previous external light signal value subtracted from the value of the present external light signals is greater than the predetermined external light signal value; continuously maintaining the pre-tunnel position value if the absolute value of the previous external light signal value subtracted from the value of the present external light signals is less than the predetermined external light signal value; and controlling the antenna as needed if the absolute value of the previous external light signal value subtracted from the value of the present external light signals is greater than the predetermined external light signal value.

According to a feature of the present invention, it is determined that the vehicle is travelling through a tunnel or a similarly obstructed location by using the fact that an average light value during daylight hours is larger than a light value when the vehicle is in a tunnel, and an average light value at night is smaller than the light value when driving in a tunnel.

In another aspect, the method of tracking a satellite antenna in a vehicle equipped with a steering angle sensor comprises the steps of establishing a steering angle sensor value to a predetermined angle value from a present vehicle position; detecting an image signal according to the predetermined angle value; comparing an image signal state with a predetermined standard value; fixing a satellite antenna position to a position when detecting the image signal in the case where the image signal state satisfies the predetermined standard value; and re-positioning the satellite antenna by a predetermined angle in the case where the image signal state does not satisfy the predetermined standard value.

According to a feature of the present invention, the steering angle sensor is used both to determine the direction at which the vehicle is travelling and for tracking the satellite antenna position.

BRIEF DESCRIPTION OF THE DRAWINGS

The accompanying drawings, which are incorporated in and constitute a part of the specification, illustrate an embodiment of the invention, and, together with the description, serve to explain the principles of the invention.

DETAILED DESCRIPTION OF THE PREFERRED EMBODIMENTS

Preferred embodiments of the present invention will now be described in detail with reference to the accompanying drawings.

Figure 1:
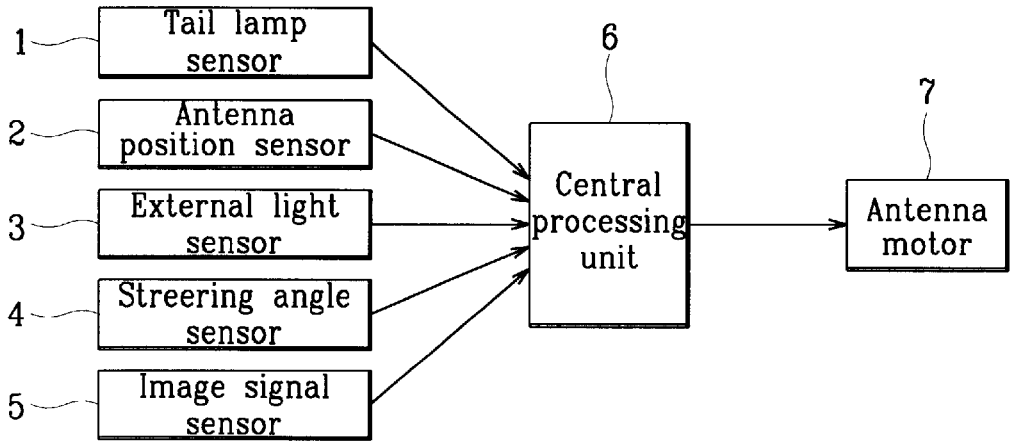
FIG. 1 is a block diagram of a satellite antenna tracking system to which the present invention is applied.

FIG. 1 shows a block diagram of a satellite antenna tracking system to which the present invention is applied.

The satellite antenna tracking system comprises a tail lamp sensor 1, an antenna position sensor 2, an external light sensor 3, a steering angle sensor 4, an image signal receiver 5, a central processing unit (CPU) 6, and an antenna drive motor 7. The satellite antenna tracking system also includes an automatic illumination system (not shown).

The CPU 6 receives signals output by the tail lamp sensor 1, antenna position sensor 2, external light sensor 3, steering angle sensor 4, and image signal receiver 5, and outputs control signals to the antenna drive motor 7 such that a satellite antenna is positioned for optimal signal reception.

Figure 2:
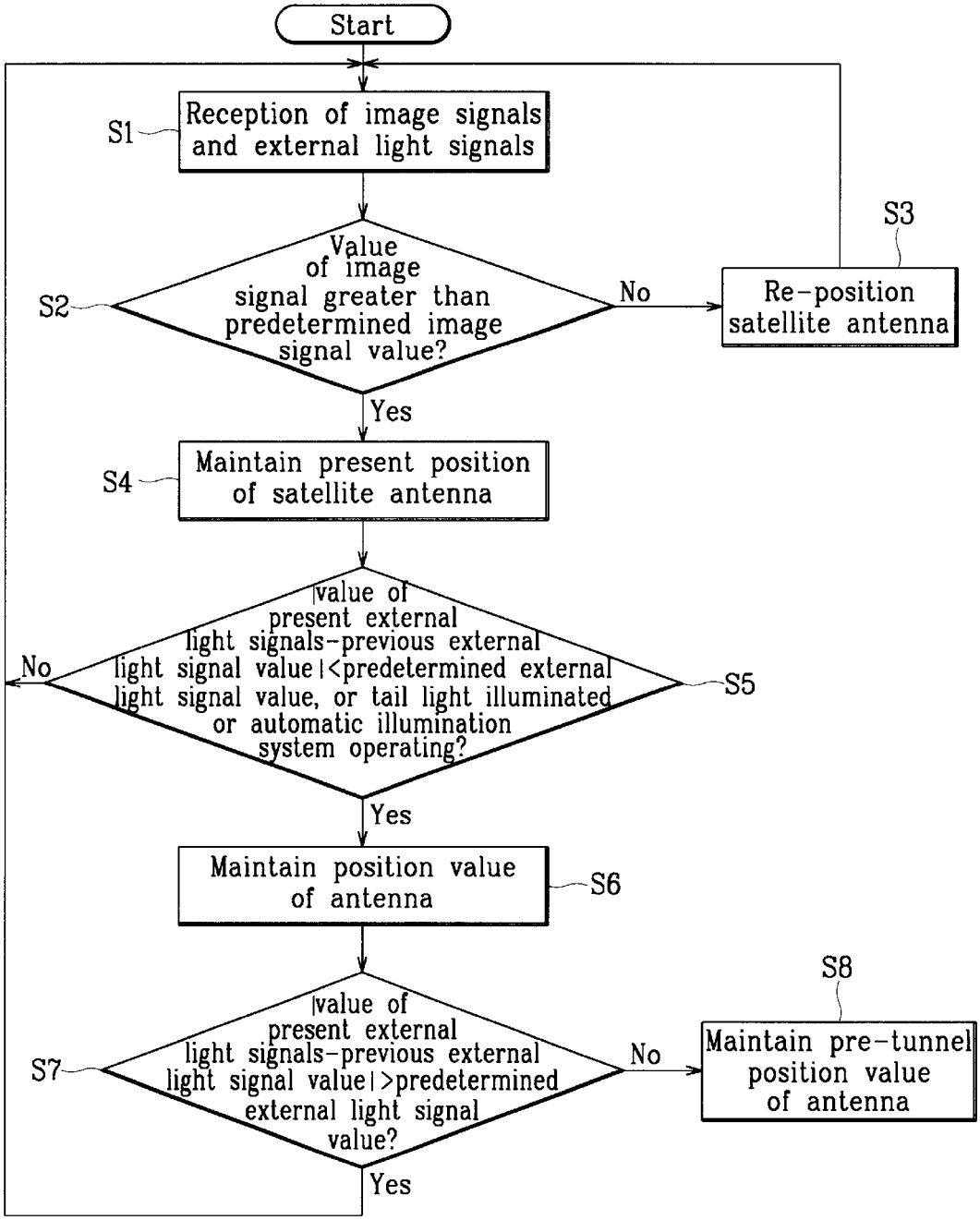
FIG. 2 is a flow chart of a tracking method for a satellite antenna according to a preferred embodiment of the present invention.

FIG. 2 shows a flow chart of a tracking method for a satellite antenna according to a preferred embodiment of the present invention.

First, the CPU 6 receives image signals and external light signals respectively from the image signal receiver 5 and the external light sensor 3 in step S1. The CPU 6 then determines if a value of the image signals is greater than a predetermined image signal value in step S2. If the value of the image signals is less than the predetermined image signal value, since this is indicative of the possibility of a worsening reception state, the satellite antenna is re-positioned such that the value of the image signals is increased in step S3. However, if the value of the image signals is greater than the predetermined image signal value, the position of the satellite antenna is maintained in the present position in step S4.

Next, it is determined if an absolute value of a previous external light signal value subtracted from a value of the present external light signals is less than a predetermined external light signal value, or if a tail light is illuminated, or if the automatic illumination system is operating in step S5. Subsequently, in step S6, if any of the three conditions of step S5 are met, the CPU 6 determines that the vehicle is traveling through a tunnel and therefore maintains a position value of the antenna corresponding to that used directly before one of the three conditions of step S5 was satisfied (i.e., a pre-tunnel position value).

The CPU 6 continues to check whether the absolute value of the previous external light signal value subtracted from the value of the present external light signals is greater than the predetermined external light signal value in step S7. If the absolute value of the previous external light signal value subtracted from the value of the present external light signals is less than the predetermined external light signal value, since this indicates that the vehicle has not yet exited the tunnel. the pre-tunnel position value of the antenna is continuously maintained in step S8. However, if the absolute value of the previous external light signal value subtracted from the value of the present external light signals is greater than the predetermined external light signal value, since this indicates that the vehicle has exited the tunnel, the process is returned to step S1. That is, the CPU 6 outputs control signals to the antenna drive motor 7 according to the signals received from the image signal receiver 5 and the external light sensor 3.

When using the external light sensor 3, it is determined that the vehicle has entered or exited a tunnel by using the fact that an average light value during daylight hours is larger than a light value when the vehicle is in a tunnel, and an average light value at night is smaller than the light value when driving in a tunnel. Accordingly, when the vehicle enters a tunnel, the CPU 6 does not perform control to change the position of the antenna, and maintains the antenna position in the pre-tunnel position during the entire time the vehicle is in the tunnel. When the vehicle exits the tunnel, since the image signal is directly located, the overall tracking time is reduced.

Figure 3:
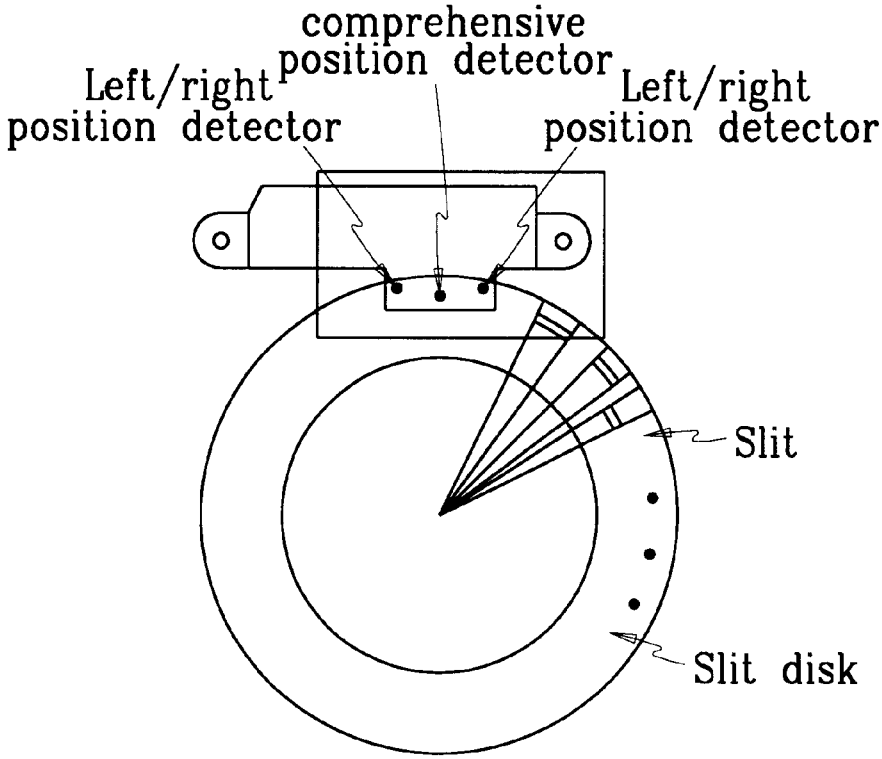
FIG. 3 is a schematic view of an orientation detection module that uses an input of a steering angle sensor.

FIG. 3 shows a schematic view of an orientation detection module that uses an input of a steering angle sensor.

As shown in FIG. 3, the orientation detection module includes a pair of left/right position detectors, a comprehensive position detector, a slit disk, and a plurality of slits formed on the slit disk. The pair of left/right position detectors, and the comprehensive position detector use the slits formed on the slit disk to determine an orientation.

Figure 4:
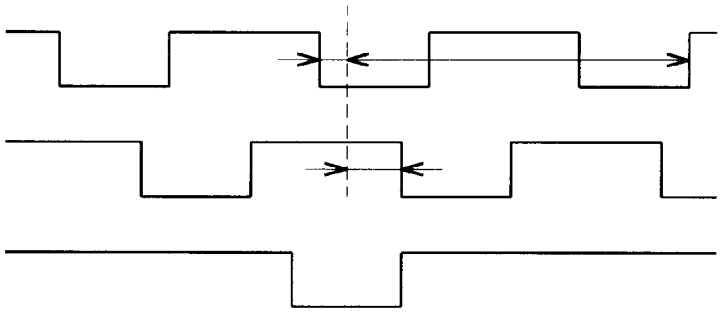
FIG. 4 is a drawing showing a waveform of output signals of the orientation detection module of FIG. 3.

FIG. 4 is a drawing showing a waveform of output signals of the orientation detection module of FIG. 3.

Instead of the conventional gyro, a steering angle sensor is used to determine the direction at which the vehicle is travelling. Since the detection of the satellite antenna is performed using the same steering angle sensor, more precise control of the antenna with relation to the direction of travel of the vehicle can be performed.

The method of using the steering angle sensor will now be described. For example, in a state where an angle of the steering angle sensor is established at left 10°, an image signal is detected. At this time, if the detected image signal is satisfactory, the present antenna position is fixed, while if the image signal is at an unacceptable level, the antenna is moved to right 10°. In this system, the level of the image signal is detected at the leftwardly or rightwardly established angle from the present position. Accordingly, an optimal image signal level according to vehicle speed is determined.

In the method of the present invention as described above, by using an external light sensor to determine when the vehicle enters a tunnel such that the antenna position is maintained for quick adjustment after exiting the tunnel, the tracking speed of the satellite antenna is improved. Further, since a steering angle sensor is used also for detection of the satellite antenna, more precise control of the antenna with relation to the direction of travel of the vehicle can be performed.

Although preferred embodiments of the present invention have been described in detail hereinabove, it should be clearly understood that many variations and/or modifications of the basic inventive concepts herein taught which may appear to those skilled in the present art will still fall within the spirit and scope of the present invention, as defined in the appended claims.

What is claimed is:

1. A method for improving a tracking speed of a satellite antenna comprising the steps of:

receiving image signals and external light signals of a vehicle;

determining if a value of the image signals is greater than a predetermined image signal value;

re-positioning a satellite antenna if the value of the image signals is less than the predetermined image signal value such that the value of the image signals is increased;

maintaining a present position of the satellite antenna if the value of the image signals is greater than the predetermined image signal value;

determining if an absolute value of a previous external light signal value subtracted from a value of the present external light signals is less than a predetermined external light signal value or if a tail light is illuminated, or if an automatic illumination system is operating;

determining that the vehicle is travelling through a tunnel or a similarly obstructed location if any of the three conditions of the above step are met, and maintaining a position value of the antenna corresponding to that used directly before one of the three conditions of the above step was satisfied (i.e., a pre-tunnel position value);

determining whether the absolute value of the previous external light signal value subtracted from the value of the present external light signals is greater than the predetermined external light signal value;

continuously maintaining the pre-tunnel position value if the absolute value of the previous external light signal value subtracted from the value of the present external light signals is less than the predetermined external light signal value; and controlling the antenna as needed if the absolute value of the previous external light signal value subtracted from the value of the present external light signals is greater than the predetermined external light signal value.

2. The method of claim 1 wherein it is determined that the vehicle is travelling through a tunnel or a similarly obstructed location by using the fact that an average light value during daylight hours is larger than a light value when the vehicle is in a tunnel, and an average light value at night is smaller than the light value when driving in a tunnel.

3. A method of tracking a satellite antenna in a vehicle equipped with a steering angle sensor comprising the steps of:

establishing a steering angle sensor value to a predetermined angle value from a present vehicle position;

detecting an image signal according to the predetermined angle value;

comparing an image signal state with a predetermined standard value;

fixing a satellite antenna position to a position when detecting the image signal in the case where the image signal state satisfies the predetermined standard value; and re-positioning the satellite antenna by a predetermined angle in the case where the image signal state does not satisfy the predetermined standard value.

4. The method of claim 3 wherein the steering angle sensor is used both to determine the direction at which the vehicle is travelling and for tracking the satellite antenna position.

* * * * *